United States Patent [19]

Swearingen

[11] Patent Number: 4,789,300

[45] Date of Patent: Dec. 6, 1988

[54] VARIABLE FLOW TURBINE EXPANDERS

[75] Inventor: Judson S. Swearingen, Malibu, Calif.

[73] Assignee: Rotoflow Corporation, Los Angeles, Calif.

[21] Appl. No.: 505,065

[22] Filed: Jun. 16, 1983

[51] Int. Cl.[4] ..... F01D 17/00

[52] U.S. Cl. ..... 415/148; 415/149 R

[58] Field of Search ..... 415/148, 150, 149 R, 415/155, 164, 209, 210

[56] References Cited

U.S. PATENT DOCUMENTS

| | | | |
|---|---|---|---|
| 2,204,169 | 6/1940 | Zerkowitz | 415/148 X |
| 2,522,131 | 9/1950 | Ravnsbeck | 415/148 |
| 2,704,089 | 3/1955 | Woodworth | 415/209 UX |
| 3,006,604 | 10/1961 | Miller | 415/148 |
| 3,232,581 | 2/1966 | Swearingen | 415/164 X |
| 3,495,921 | 2/1970 | Swearingen | 415/163 |
| 3,635,580 | 1/1972 | Richardson et al. | 415/150 |
| 3,994,620 | 11/1976 | Spraker, Jr. et al. | 415/209 X |
| 4,300,869 | 11/1981 | Swearingen | 415/160 |

FOREIGN PATENT DOCUMENTS

| | | | |
|---|---|---|---|
| 232986 | 9/1969 | U.S.S.R. | 415/209 |

*Primary Examiner*—Robert E. Garrett
*Assistant Examiner*—Joseph M. Pitko
*Attorney, Agent, or Firm*—Lyon & Lyon

[57] ABSTRACT

A radial inflow turbine having an axial discharge divided into concentric passages. The inner concentric passage or passages may be selectively blocked by means of a valve to accommodate a first range of flow rate. At higher flow rates, the valve is open to increase the effective nozzle area of the secondary nozzles at the discharge of the turbine wheel.

10 Claims, 1 Drawing Sheet

FIG. 1.
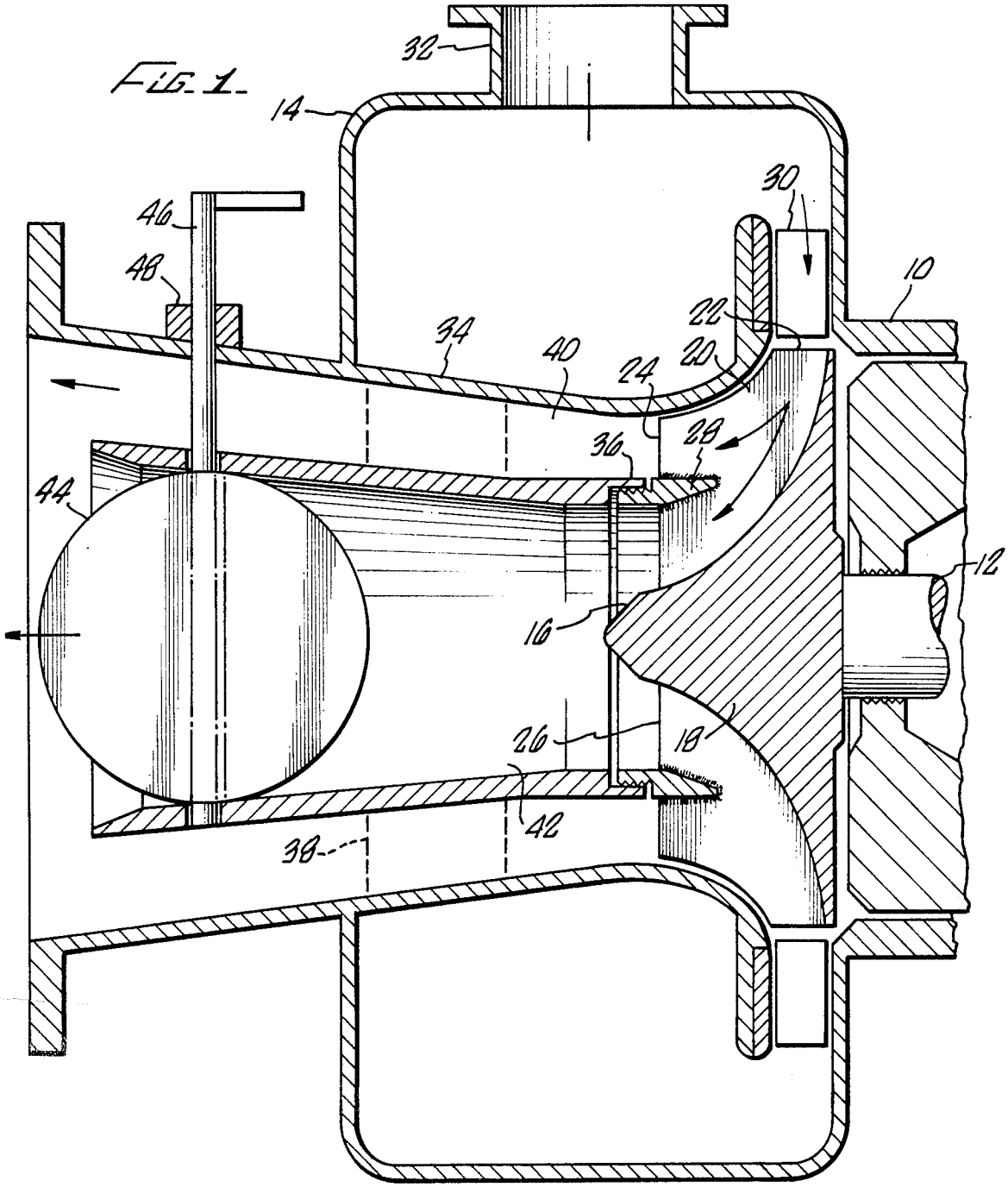
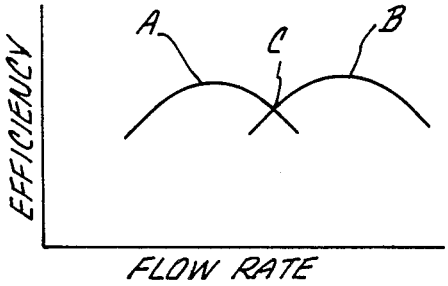
FIG. 2.

VARIABLE FLOW TURBINE EXPANDERS

BACKGROUND OF THE INVENTION

The field of the present invention is radial inflow turbine expanders.

Radial inflow turbine expanders which employ variable primary nozzles have a reasonably wide range of flow. Such turbine expanders, or turboexpanders as they are often referred to, include nozzle blades which are pivotally mounted parallel to the axis of the turbine wheel and arranged in an annular inlet about the inlet to the turbine wheel. These blades may be caused to vary in orientation so as to increase or decrease the nozzle area between blades. In this way, the turbine may be adjusted to accommodate a range of flows with maximum practical efficiency. A recent patent illustrating one system contemplated for use with the present invention is U.S. Pat. No. 4,300,869, for Method & Apparatus for Controlling Clamping Forces in Fluid Flow Control Assemblies to Swearingen, the disclosure of which is incorporated herein by reference. See also, U.S. Pat. Nos. 3,232,581 and 3,495,921, also incorporated herein by reference.

Associated with such variable inlet nozzle turbines are secondary nozzles located at the discharge of the turbine wheel and defined by the blades of the wheel. These secondary nozzles are necessarily of fixed cross-sectional area and serve to jet the discharge from the turbine wheel backward as it leaves the wheel relative to the motion of the wheel. In doing so, the flow thus discharged may be arranged to leave the turbine wheel through the discharge with no angular momentum. In this way, the energy otherwise lost in spinning flow discharged from the turbine is avoided in favor of the realization of additional useful power to the turbine.

In such radial inflow turbines, reduced flow is accommodated by adjusting the inflow nozzles. The flow which is discharged from the turbine wheel tends to be thrown outwardly by centrifugal force such that the inner portion of the flow nearest to the axis of the turbine wheel at the discharge will be substantially diminished while flow near the periphery of the discharge will still better approximate the flow at optimum flow rates. As a result, the secondary nozzles still perform reasonably well to reduce angular momentum in the discharge. Naturally, the unavoidable fixed losses in the turbine must be prorated against a smaller flow. Efficiency is correspondingly diminished. This diminution in efficiency is generally unavoidable.

Flows larger than the design flow or optimum flow of said device are generally accommodated by the opening to a greater extent of the primary nozzles. The secondary nozzles are fixed and must simply accommodate more flow through the same nozzle area. In order to do so, the flow velocity must be increased. This induces a swirl in the discharge which naturally usurps energy from the system. Additionally, the secondary nozzles require additional differential pressure to establish the higher flow of velocity. Because of this additional pressure energy requirement, less energy is available for the primary nozzles. As a result, the primary stream is introduced tangentially into the turbine wheel at lower than optimum velocities. Further losses are experienced because of the velocity mismatch between the inlet flow from the primary nozzles and the peripheral speed of the turbine wheel. The flow impacts upon the turbine wheel because of the mismatch, resulting in reduced efficiency.

Because of the natural accommodation of below optimum flow rates in such radial inflow turbines, the major efficiency losses are understood to occur at flow rates above the optimum flow rate of the device. The major losses at higher than optimum flow rates are understood to be impact loss at the turbine wheel inlet, the loss due to angular momentum of the gas at the discharge and the passing of excessive flow at elevated pressures through the fixed secondary nozzles. In spite of such losses, many systems employing turboexpanders experience variations in flow rate both below and above the optimum.

SUMMARY OF THE INVENTION

The present invention is directed to a turbine expander of the type having an axial discharge which is able to stepwise accommodate a wide variation in flow rates. To this end, the discharge of the turbine assembly is divided into multiple passages for discharge flow. One or more of the passages may have a valve for selectively blocking flow therethrough. The turboexpander may then be devised for a given range of flow rates substantially greater than can be reasonably accommodated by a conventional turbine expander. In providing a mechanism for blocking a portion of the discharge, the present invention is using to the best advantage the characteristics of such devices. Excessive flow not easily accommodated by fixed secondary nozzles is avoided while less objectionable flow below capacity is accommodated and enhanced.

In one aspect of the present invention, the passages are concentric with the valve or valves working on the inner passages. Such an arrangement makes best use of the natural condition of reduced flow. As the flow tends to move out under centrifugal force, it will be naturally accommodated by the outer annular passage or passages. The center flow is blocked under such conditions where that flow is substantially reduced even without such blockage.

BRIEF DESCRIPTION OF THE DRAWINGS

FIG. 1 illustrates a cross-sectional view taken along the axis of a turbine expander.

FIG. 2 illustrates a characteristic curve of efficiency versus flow rate for a device of the present invention.

DETAILED DESCRIPTION OF THE PREFERRED EMBODIMENT

Turning in detail to FIG. 1, a turboexpander is illustrated generally in cross section. The device includes a casing 10 within which is rotatably mounted a shaft 12. A case enclosure 14 extends forwardly from the case 10 to surround a turbine wheel 16 fixed to the shaft 12.

The turbine wheel 16 includes a rotor 18 and a plurality of blades 20 positioned about the rotor 18. The rotor 18 and blades 20 of the turbine wheel 16 are arranged for greatest efficiency at a first flow rate in conformance with general principles of turbine design. The turbine wheel includes an inlet periphery 22 which extends about the periphery of the turbine wheel as divided into segments by the blades 20. The turbine wheel also includes an axial discharge, again divided into segments by the turbine blades 20. The segments thus divided at the discharge are considered to act as secondary nozzles which direct the flow at optimum flow rates such that it will discharge without angular momentum. In the present turbine wheel 16, two sets of nozzles 24 and 26 are located at the discharge. These nozzles would be combined into a single set but for the cylindrical partition 28 which is fixed to the blades 20. The cylindrical partition 28 creates concentric sets of nozzles 24 and 26 through which flow between the blades 20 may be discharged from the turbine wheel 16.

Surrounding the turbine wheel 16 are primary nozzles 30. The primary nozzles 30 are arranged about the entire periphery 22 of the turbine wheel 16 so as to provide conditioned input to the turbine wheel. The flow thus input through the nozzles 30 is received from the case enclosures 14 originally introduced through an inlet 32.

At the discharge side of the turbine wheel 16, a first exducer 34 diverges away from the discharge area of the turbine wheel 16. The exducer 34 is configured continuously from the casing about the turbine cavity.

Inwardly of the exducer 34 is a concentrically arranged wall 36 which is conveniently generally circular in cross section and diverges outwardly away from the discharge of the turbine wheel 16. Supports 38 may be positioned about the exducer 34 so as to support the wall 36. The wall 36 extends inwardly toward the discharge to come into close association with the cylindrical partition 28. The wall 36 and cylindrical partition 28 meet at a labyrinth seal to avoid any substantial leakage of flow across the barrier thus defined. The presence of the cylindrical partition 28 and the wall 36 divides the discharge and the exducer into two discharge passages. A first, annular discharge passage 40 is concentrically positioned about a second, central passage 42.

Located in the central passage 42 is a butterfly valve 44. The butterfly valve is pivotally mounted in the central passage 42 to the wall 36. The butterfly valve 44 is thus able to close on selective actuation which may either be manual or automatic responsive to flow rate through the system to block flow through the central passage 42. A stem 46 and stuffing box 48 are arranged to control the butterfly valve 44.

In operation, pressurized flow is introduced through the inlet 32 into the case enclosure 14. This flow is then directed to the nozzles 30 which may be adjustable to accommodate the flow rate anticipated. As the flow is expanded through the turbine 16, work is derived to be delivered through shaft 12. With flow in a first range, the butterfly valve 44 is closed. Therefore, pressure builds up within the wall 36 and upstream of the valve 44 until all flow passing through the turbine wheel 16 exists into the annular passage 40 for discharge. With the flow in the first range contemplated, the passage 40 and the secondary nozzles 24 are presented with an appropriate flow rate. Additionally, as the centrifugal effect of rotation of the turbine wheel 16 directs the flow outwardly, little efficiency is lost by closing the valve 44.

When increased flow is experienced, the valve 44 may be opened to provide a second secondary nozzle configuration having an effective large nozzle area. The primary nozzle 30 may also be rearranged to provide efficient introduction of flow. With the added secondary nozzle area, the major deficiencies associated with invariable secondary nozzle configurations are overcome. In allocating flow capacity between passages 40 and 42, the outer passage is preferably open at all times because of the natural tendency of flow under centrifugal action. The percentage of flow capability which may be provided by the inner passage 42 is discretionary but is believed to be advantageous in the order of 50% of the design flow for the system with the valve 44 blocking the passage 42. Thus, the device is capable of 150% with the valve 44 in the open position and may approach 200% flow without substantial loss. A curve characteristic of the present system is illustrated in FIG. 2. Each of the configurations, the valve open and the valve closed, has a peak efficiency with the efficiency dropping off from those points. By appropriately selecting the peak efficiencies at "A" and "B", a broad range of flow capability can be realized. Additionally, the valve 44 is preferably actuated at the point "C" where the efficiency curves intersect.

Accordingly, an inflow turbine assembly is disclosed which provides a broad range of flow rate capacity. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A turbine assembly comprising
an inlet;
a turbine wheel including a rotor and blades fixed to said rotor and extending to an axial discharge;
an exducer having a first, annular passage extending from said axial discharge and a second, central passage extending from said axial discharge; and
a vale in one of said first and second passages to selectively block flow therethrough.

2. The turbine assembly of claim 1 wherein said first and second passages are mutually concentric.

3. The turbine assembly of claim 1 wherein said valve is a butterfly valve.

4. The turbine assembly of claim 1 wherein said inlet includes annularly disposed variable primary nozzles.

5. The turbine assembly of claim 1 wherein said turbine wheel includes a cylindrical partition fixed to said blades at said axial discharge.

6. A turbine assembly comprising
an inlet;
a turbine wheel including a rotor and blades fixed to said rotor and extending to an axial discharge;
an exducer having a plurality of concentric passages extending from said axial discharge; and
a valve in at least one of said plurality of passages to selectively block flow therethrough.

7. The turbine assembly of claim 6 wherein said inlet includes annularly disposed variable primary nozzles.

8. A turbine assembly comprising
an inlet;
a turbine wheel including a rotor and blades fixed to said rotor and extending to an axial discharge;
an exducer having a first, annular passage extending from said axial discharge and a second, central passage extending from said axial discharge; and
a valve in said second passage to selectively block flow therethrough.

9. A turbine assembly comprising
an inlet;
a turbine wheel including a rotor and blades fixed to said rotor and extending to an axial discharge, said turbine wheel further including a cylindrical partition fixed to said blades at said axial discharge;
an exducer having a first, annular passage extending from said axial discharge and a second, central passage extending from said axial discharge, said first and second passages being mutually concentric and including a wall therebetween, said wall being aligned with said circular partition; and a valve in one of said first and second passages to selectively block flow therethrough.

10. The turbine assembly of claim 9 wherein said cylindrical partition and said wall are joined at a labyrinth seal.

* * * * *